US011781342B2

(12) United States Patent
Yalamati et al.

(10) Patent No.: US 11,781,342 B2
(45) **Date of Patent: *Oct. 10, 2023**

(54) NOISE-REDUCING STRIKE BOX

(71) Applicant: Schlage Lock Company LLC, Carmel, IN (US)

(72) Inventors: Bhargav Yalamati, Hyderabad (IN); Prabhat Kumar Yadav, Bangalore (IN)

(73) Assignee: Schlage Lock Company LLC, Carmel, IN (US)

( * ) Notice: Subject to any disclaimer, the term of this patent is extended or adjusted under 35 U.S.C. 154(b) by 30 days.

This patent is subject to a terminal disclaimer.

(21) Appl. No.: 17/361,553

(22) Filed: Jun. 29, 2021

(65) Prior Publication Data

US 2022/0127877 A1 Apr. 28, 2022

Related U.S. Application Data

(63) Continuation of application No. 15/877,866, filed on Jan. 23, 2018, now Pat. No. 11,047,150.

(51) Int. Cl.
*E05B 15/02* (2006.01)
*E05B 63/24* (2006.01)
(Continued)

(52) U.S. Cl.
CPC ..... *E05B 15/0205* (2013.01); *E05B 9/002* (2013.01); *E05B 9/02* (2013.01);
(Continued)

(58) Field of Classification Search
CPC ..... Y10T 292/68; Y10T 292/688; Y10T 292/691; Y10T 292/696; Y10T 292/702; Y10T 292/705; E05B 15/0205; E05B 15/022; E05B 15/00; E05B 15/02; E05B 9/002; E05B 9/02; E05B 9/08; E05B 2009/004; E05B 63/24; E05B 63/003; E05B 63/12; E05B 63/127; E05B 17/0045;
(Continued)

(56) References Cited

U.S. PATENT DOCUMENTS 2,353,844 A 7/1944 Milner
2,869,913 A 1/1959 Schlage
(Continued)

FOREIGN PATENT DOCUMENTS

DE 19639253 A1 11/1997
DE 10253240 A1 5/2004
FR 2344695 A1 10/1977

*Primary Examiner* — Alyson M Merlino
(74) *Attorney, Agent, or Firm* — Taft Stettinius & Hollister LLP

(57) ABSTRACT

An exemplary strike box is configured for use with a lockset including a bolt operable to move in an extending direction and a retracting direction. The strike box includes a housing having an opening sized and configured to receive the bolt, and further includes a bolt-slowing mechanism mounted in the housing. The bolt-slowing mechanism is configured to engage the bolt as the bolt moves in the extending direction, and to exert a force urging the bolt in the retracting direction. The force exerted by the bolt-slowing mechanism slows the extension speed of the bolt, such that the strike box reduces noise generated during such extension.

21 Claims, 5 Drawing Sheets

(51) Int. Cl.

| | |
|---|---|
| ***E05B 9/02*** | (2006.01) |
| ***E05B 9/00*** | (2006.01) |
| ***E05B 9/08*** | (2006.01) |
| ***E05B 17/00*** | (2006.01) |

(52) U.S. Cl.
CPC ..... *E05B 9/08* (2013.01); *E05B 15/022* (2013.01); *E05B 17/0045* (2013.01); *E05B 63/24* (2013.01); *E05B 2009/004* (2013.01)

(58) Field of Classification Search
CPC ... E05C 7/04; E05C 7/045; E05C 7/06; Y10S 292/55; Y10S 292/56; Y10S 292/57; Y10S 292/73
See application file for complete search history.

(56) References Cited

U.S. PATENT DOCUMENTS

| | | | | |
|---|---|---|---|---|
| 4,118,056 | A | 10/1978 | Alexander | |
| 4,401,230 | A | 8/1983 | Hall | |
| 4,595,220 | A | 6/1986 | Hanchett, Jr. et al. | |
| 4,971,373 | A | 11/1990 | Hamada et al. | |
| 5,757,269 | A | 5/1998 | Roth et al. | |
| 5,990,579 | A | 11/1999 | Ricci | |
| 6,120,071 | A | 9/2000 | Picard et al. | |
| 6,393,878 | B1 | 5/2002 | Fayngersh et al. | |
| 6,595,605 | B1 | 7/2003 | Baback et al. | |
| 8,348,309 | B2 | 1/2013 | Patel et al. | |
| 8,783,744 | B2 | 7/2014 | Scheffler et al. | |
| 9,765,550 | B2 | 9/2017 | Hemmingsen et al. | |
| 9,856,675 | B2 * | 1/2018 | Ilardo | E05B 7/00 |
| 10,072,447 | B2 * | 9/2018 | Fujiwara | E05B 81/36 |
| 10,794,096 | B2 * | 10/2020 | Hamacher | E05B 5/006 |
| 10,829,953 | B2 * | 11/2020 | Esterle | E05B 17/0045 |
| 11,454,052 | B2 * | 9/2022 | Guerin | E05B 85/103 |
| 2008/0178530 | A1 | 7/2008 | Ellerton et al. | |
| 2012/0174692 | A1 | 7/2012 | Haida et al. | |
| 2014/0159395 | A1 | 6/2014 | Scheffler et al. | |
| 2015/0218856 | A1 | 8/2015 | Sayama et al. | |
| 2015/0247347 | A1 | 9/2015 | Suzumura et al. | |
| 2020/0018092 | A1 * | 1/2020 | Schappler | E05B 15/022 |

* cited by examiner

NOISE-REDUCING STRIKE BOX

CROSS REFERENCE TO RELATED APPLICATIONS

The present application is a continuation of U.S. patent application Ser. No. 15/877,866 filed Jan. 23, 2018 and issued as U.S. Pat. No. 11,047,150, the contents of which are hereby incorporated by reference in their entirety.

TECHNICAL FIELD

The present disclosure generally relates to strike boxes for locksets, and more particularly but not exclusively relates to strike boxes for mortise locksets.

BACKGROUND

Strike boxes are commonly used in combination with locksets to facilitate the latching and/or locking of a door to a frame, and often include at least one pocket sized and configured to receive a movable bolt of the lockset. When the door is in a closed position, the bolt projects into the pocket, thereby releasably securing the door to the frame. Some such combinations have certain drawbacks, such as those related to generation of excess noise during operation of the lockset. Therefore, a need remains for further improvements in this technological field.

SUMMARY

An exemplary strike box is configured for use with a lockset including a bolt operable to move in an extending direction and a retracting direction. The strike box includes a housing having an opening sized and configured to receive the bolt, and further includes a bolt-slowing mechanism mounted in the housing. The bolt-slowing mechanism is configured to engage the bolt as the bolt moves in the extending direction, and to exert a force urging the bolt in the retracting direction. The force exerted by the bolt-slowing mechanism slows the extension speed of the bolt, such that the strike box reduces noise generated during such extension. Further embodiments, forms, features, and aspects of the present application shall become apparent from the description and figures provided herewith.

BRIEF DESCRIPTION OF THE FIGURES

FIG. 4*a* illustrates an unlatched/unlocked state, FIG. 4*b* illustrates a latched/unlocked state, and FIG. 4*c* illustrates a latched/locked state.

DETAILED DESCRIPTION OF ILLUSTRATIVE EMBODIMENTS

Figure 1:
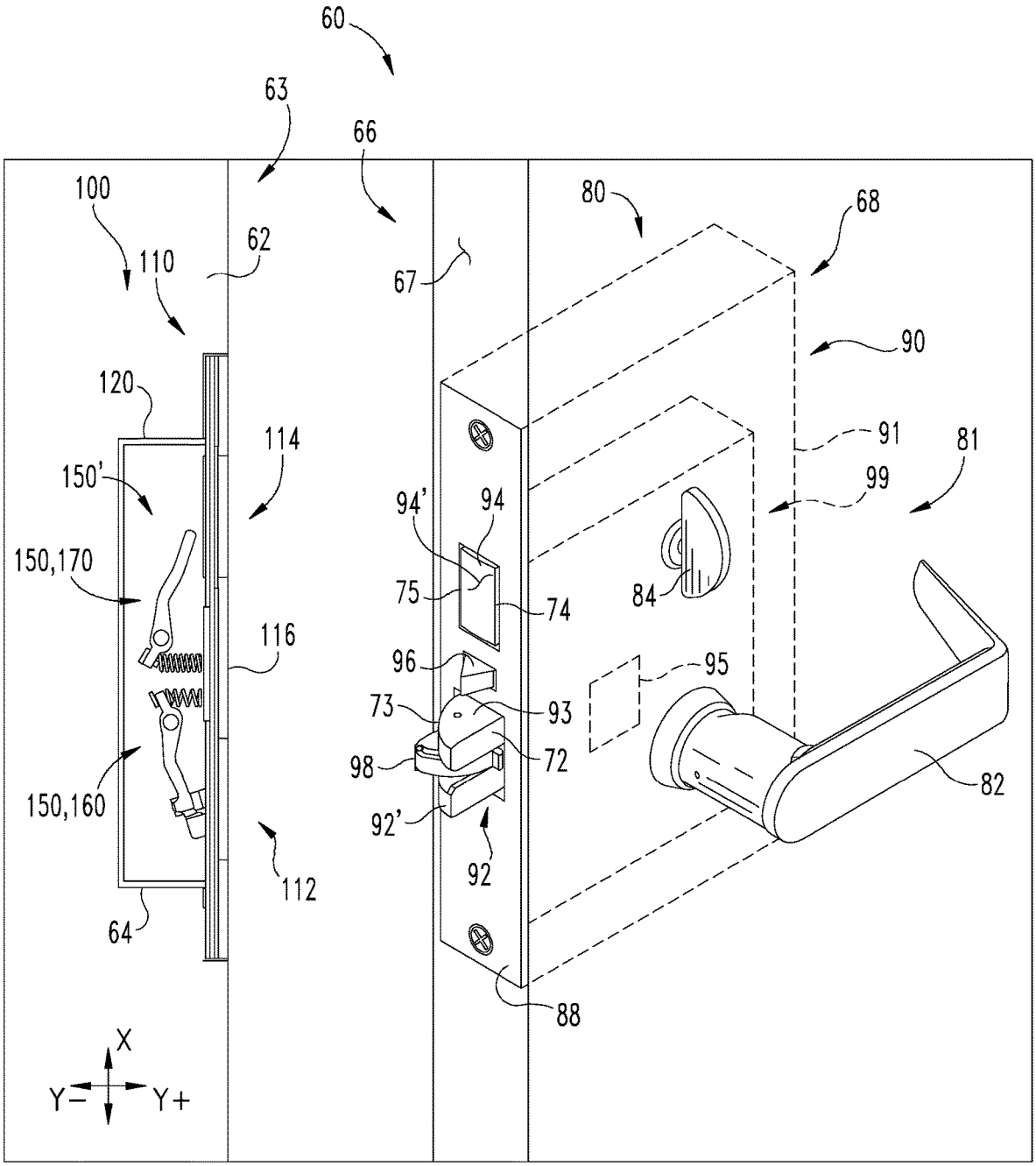
FIG. 1 illustrates a closure assembly with a lockset and a strike box according to certain embodiments.

Although the concepts of the present disclosure are susceptible to various modifications and alternative forms, specific embodiments have been shown by way of example in the drawings and will be described herein in detail. It should be understood, however, that there is no intent to limit the concepts of the present disclosure to the particular forms disclosed, but on the contrary, the intention is to cover all modifications, equivalents, and alternatives consistent with the present disclosure and the appended claims.

References in the specification to "one embodiment," "an embodiment," "an illustrative embodiment," etc., indicate that the embodiment described may include a particular feature, structure, or characteristic, but every embodiment may or may not necessarily include that particular feature, structure, or characteristic. Moreover, such phrases are not necessarily referring to the same embodiment. It should further be appreciated that although reference to a "preferred" component or feature may indicate the desirability of a particular component or feature with respect to an embodiment, the disclosure is not so limiting with respect to other embodiments, which may omit such a component or feature. Further, when a particular feature, structure, or characteristic is described in connection with an embodiment, it is submitted that it is within the knowledge of one skilled in the art to implement such feature, structure, or characteristic in connection with other embodiments whether or not explicitly described.

Additionally, it should be appreciated that items included in a list in the form of "at least one of A, B, and C" can mean (A); (B); (C); (A and B); (B and C); (A and C); or (A, B, and C). Similarly, items listed in the form of "at least one of A, B, or C" can mean (A); (B); (C); (A and B); (B and C); (A and C); or (A, B, and C). Further, with respect to the claims, the use of words and phrases such as "a," "an," "at least one," and/or "at least one portion" should not be interpreted so as to be limiting to only one such element unless specifically stated to the contrary, and the use of phrases such as "at least a portion" and/or "a portion" should be interpreted as encompassing both embodiments including only a portion of such element and embodiments including the entirety of such element unless specifically stated to the contrary.

As used herein, the terms "longitudinal," "lateral," and "transverse" are used to denote motion or spacing along three mutually perpendicular axes, wherein each of the axes defines two opposite directions. In the coordinate system illustrated in FIG. 2, the X-axis defines first and second longitudinal directions, the Y-axis defines first and second lateral directions, and the Z-axis defines first and second transverse directions. The lateral directions defined by the Y-axis may alternatively be referred to herein as the proximal direction ($Y^+$) and the distal ($Y^-$) direction, and the transverse directions defined by the Z-axis may alternatively be referred to herein as the forward direction ($Z^+$) and the rearward direction ($Z^-$). In the orientation illustrated in FIG. 1, the longitudinal axis (X) is a vertical axis, and each of the lateral axis (Y) and the transverse axis (Z) is a horizontal axis. However, it is to be appreciated that these terms are used for ease and convenience of description, and are without regard to the orientation of the system with respect to the environment. For example, descriptions that reference a longitudinal direction may be equally applicable to a vertical direction, a horizontal direction, or an off-axis orientation with respect to the environment.

Furthermore, motion or spacing along a direction defined by one of the axes need not preclude motion or spacing along a direction defined by another of the axes. For example, elements which are described as being "laterally offset" from one another may also be offset in the longitudinal and/or transverse directions, or may be aligned in the longitudinal and/or transverse directions. The terms are therefore not to be construed as limiting the scope of the subject matter described herein.

With reference to FIG. 1, illustrated therein are a closure assembly 60 and a lockset 80, along with a strike box 100 according to certain embodiments. The closure assembly 60 includes a frame 62 and a door 66, and may further be considered to include the lockset 80 and/or the strike box 100. The frame 62 includes a side jamb 63 having a frame cutout 64 in which at least a portion of the strike box 100 is seated. The door 66 includes a free edge 67 and a door cutout 68 that extends from the free edge 67, and in which at least a portion of the lockset 80 is seated. The door 66 is pivotally mounted to the frame 62 for swinging movement between an open position in which the free edge 67 is offset from the side jamb 63, a partially-closed position in which the free edge 67 faces and partially overlaps the side jamb 63, and a fully-closed position in which the free edge 67 is aligned with the side jamb 63.

In the illustrated embodiment, the lockset 80 is provided in the form of a mortise lockset, and includes a trim assembly 81 mounted to the face of the door 66, and a mortise chassis 90 seated in the door cutout 68. The lockset 80 also includes a faceplate 88 that is secured to the free edge 67 of the door 66, thereby retaining the chassis 90 within the door cutout 68. The trim assembly 81 includes a first manual actuator 82 and a second manual actuator 84, which in the illustrated embodiment are provided in the form of a handle 82 and a thumbturn 84.

The chassis 90 includes a latchbolt 92, a deadbolt 94, and a mortise case 91 in which the bolts 92, 94 are movably mounted. The chassis 90 may further include a trigger 96, which in the illustrated form is movably mounted between the latchbolt 92 and the deadbolt 94. Each of the latchbolt 92 and the deadbolt 94 is movable between an extended position in which the bolt 92/94 projects beyond the faceplate 88 and is operable to engage the strike box 100, and a retracted position in which the bolt 92/94 is positioned at least primarily within the case 91. Similarly, the trigger 96 is movable between a projected position in which the trigger 96 projects beyond the faceplate 88, and a depressed position in which the trigger 96 is positioned at least primarily within the case 91. The latchbolt 92 is biased toward its extended position, and the trigger 96 is biased toward its projected position. The latchbolt 92 includes a latchbolt head 93, and may further include a tongue 98 movably mounted to the latchbolt head 93. The tongue 98 may facilitate movement of the latchbolt 92 between its extended and retracted positions, for example by reducing or counteracting resistive forces resulting from frictional engagement with the faceplate 88, the case 91 and/or the strike box 100.

The latchbolt 92 has a first side surface 72 that faces the door-opening direction, and a second side surface 73 that faces the door-closing direction. Similarly, the deadbolt 94 has a first side surface 74 that faces the door-opening direction, and a second side surface 75 that faces the door-closing direction. Each of the first side surfaces 72, 74 is provided as a flat side surface 72/74 operable to engage a fixed edge of the strike box 100 to prevent movement of the corresponding bolt 92/94 in the door-opening direction. The second side surface 73 of the latchbolt 92 is provided as a beveled surface 73 that cooperates with the strike box 100 during door-closing movements to drive the latchbolt 92 toward its retracted position. By contrast, the second side surface 75 of the deadbolt 94 is a flat side surface 75.

The chassis 90 further includes a transmission assembly 99 that is operatively connected with the trim assembly 81, the latchbolt 92, and the deadbolt 94. More specifically, the transmission assembly 99 drivingly connects the handle 82 with the latchbolt 92, and drivingly connects the thumbturn 84 with the deadbolt 94. As a result, the handle 82 is operable to drive the latchbolt 92 from its extended position to its retracted position, and the thumbturn 84 is operable to drive the deadbolt 94 between its extended and retracted positions. In the illustrated form, the transmission assembly 99 is also operatively connected with the trigger 96.

In certain embodiments, the transmission assembly 99 may connect the deadbolt 94 with one or more other components of the lockset 80 to provide for automatic movement of the deadbolt 94 in response to one or more actions. For example, the transmission assembly 99 may be configured to retract the deadbolt 94 in response to actuation of the handle 82, thereby providing for automatic unlocking when the lockset 80 is operated from the secured side of the door 66. As another example, the transmission assembly 99 may interconnect the latchbolt 92, the deadbolt 94, and the trigger 96 to provide for automatic extension of the deadbolt 94 when the door 66 is driven to its closed position. In such forms, the transmission assembly 99 may be configured to drive the deadbolt 94 toward its extended position in response to extension of the latchbolt 92 when the trigger 96 is in its depressed position, thereby providing for automatic locking when the door 66 is closed. The transmission assembly 99 may be provided in any of a number of forms known within the art, and the manner in which transmission assembly 99 performs the above-described functions need not be described in further detail herein.

The strike box 100 has a length extending along a longitudinal (X) axis, a depth extending along a lateral (Y) axis, and a width extending along a transverse (Z) axis. The strike box 100 includes a housing 110 having a latchbolt opening 112 operable to receive the latchbolt 92, a deadbolt opening 114 operable to receive the deadbolt 94, and a plate portion 116 that is positioned between and separates the openings 112, 114. When the door 66 is in its closed position and the bolts 92/94 move toward the extended positions thereof, the bolts 92/94 enter the openings 112/114 and travel in the distal ($Y^-$) direction. When the bolts 92/94 are subsequently moved toward the retracted positions thereof, the bolts 92/94 travel in the proximal ($Y^+$) direction and exit the openings 112/114. Accordingly, the distal ($Y^-$) direction and the proximal ($Y^+$) direction may alternatively be referred to as the bolt-extending ($Y^-$) direction and the bolt-retracting ($Y^+$) direction.

During operation of the closure assembly 60, the door 66 may be driven from its open position to its partially-closed position. As the door 66 travels to its partially-closed position, the frame 62 and/or the housing 110 engage the latchbolt 92, thereby driving the latchbolt 92 toward its retracted position against the biasing forces that urge the latchbolt 92 toward its extended position. The trigger 96 may similarly be engaged by the frame 62 and/or the housing 110 such that the trigger 96 is driven to its retracted position against the biasing forces provided by the chassis 90. When the door 66 approaches its fully-closed position, the latchbolt 92 enters the latchbolt opening 112 as the chassis 90 returns the latchbolt 92 to its extended position. With the trigger 96 retained in its depressed position by the plate portion 116, the transmission assembly 99 may drive the deadbolt 94 toward its extended position in response to extension of the latchbolt 92, thereby causing the deadbolt 94 to enter the deadbolt opening 114. Alternatively, the deadbolt 94 may be driven to its extended position by manual operation of the thumbturn 84. With the bolts 92, 94 received in the openings 112, 114, the door 66 is secured in its closed position relative to the frame 62.

It has been found that during door-closing operations of the type described above, the lockset 80 may produce audible noise that can be objectionable in certain settings. One factor contributing to such noise generation is contact between various components that impact or slide along one another as the latchbolt 92 and/or the deadbolt 94 move to the extended positions thereof. As one example, noise may be generated as a result of moving components of the transmission assembly 99 contacting one another and/or the mortise case 91 during extension of one or both of the bolts 92, 94. As another example, noise may be generated as a result of the tongue 98 may contacting the faceplate 88 and/or the strike box housing 110 as the latchbolt 92 moves to its extended position.

The amount of noise generated during the above-described door-closing operation may be reduced by the strike box 100, which is configured to slow the extension speed of the latchbolt 92 and/or the deadbolt 94. The strike box 100 includes a bolt-slowing assembly 150' configured to slow the extension speed of the latchbolt 92 and/or the deadbolt 94, thereby reducing the amount of noise generated by the lockset 80 during such extension. As described herein, the bolt-slowing assembly 150' includes at least one slowing mechanism 150 that is mounted in the housing 110, and which is aligned with at least one of the openings 112, 114 such that the latchbolt 92 and/or the deadbolt 94 engage the slowing mechanism 150 during extension.

Figure 2:
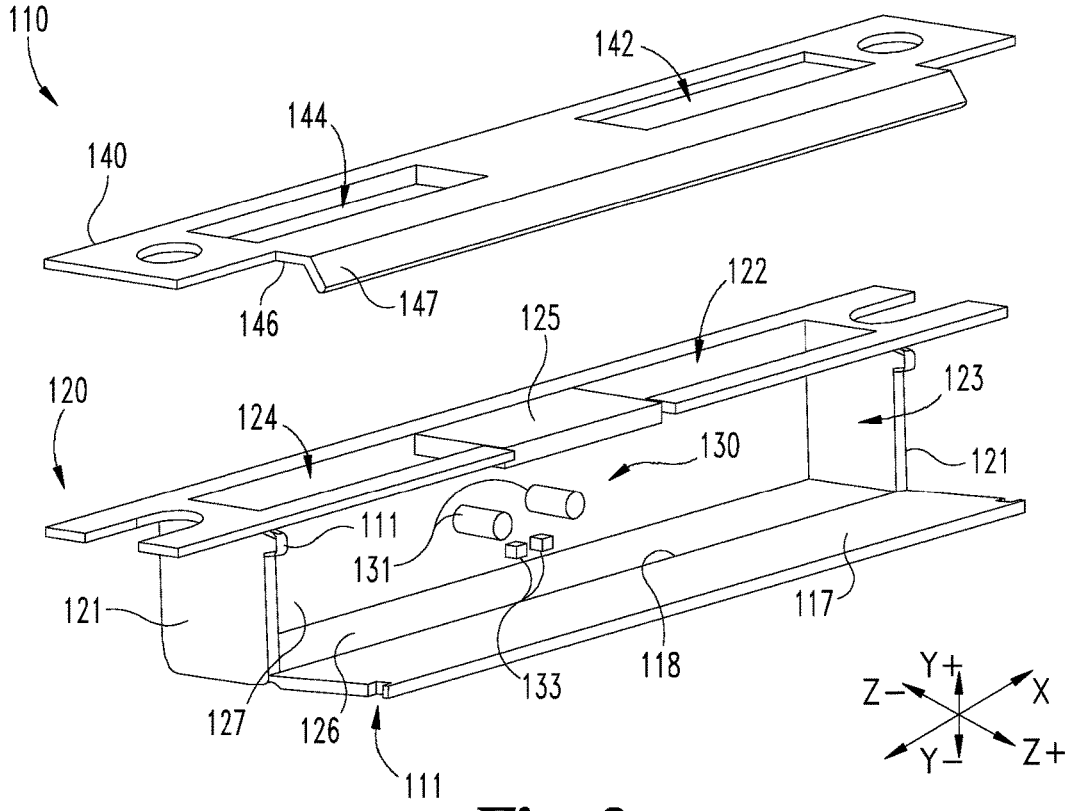
FIG. 2 is a perspective illustration of a portion of the strike box illustrated in FIG. 1.

With additional reference to FIG. 2, the housing 110 includes a case 120, a mounting device 130 positioned in the case 120, and a strike plate 140 configured for mounting to the case 120. The case 120 defines a first opening 122, a second opening 124, and a partially-enclosed chamber 123 connected with the first opening 122 and the second opening 124. The chamber 123 is delimited by a plurality of walls, including a pair of longitudinally-spaced end walls 121, a proximal wall 125 positioned between the openings 122, 124, a distal wall 126 opposite the proximal wall 125, and a rear wall 127 connected between the proximal wall 125 and the distal wall 126.

The housing 110 also includes a front wall 117 that is movable relative to the case 120 between a closed position and an open position, and may further include a retaining device 111 operable to selectively retain the front wall 117 in the closed position. By way of example, the retaining device 111 may be provided in the form of mating snap features. With the front wall 117 in the open position, the front side of the chamber 123 is open, thereby exposing the mounting device 130. When in the closed position, the front wall 117 is positioned opposite the rear wall 127 and partially encloses the chamber 123. In the illustrated form, the front wall 117 is connected to the case 120 via a hinge connection 118 such that the front wall 117 pivots between the open position and the closed position. In certain embodiments, the front wall 117 may be integrally formed with the case 120, and the hinge connection 118 may be provided as a living hinge. For example, the case 120 may be formed of a plastic material, and the hinged connection 118 may be formed with a lesser thickness than the front wall 117 and the distal wall 126 such that the living hinge is flexible. It is also contemplated that the front wall 117 may be operable to move relative to the case 120 in another manner, and may be detachable from the case 120. By way of example, the front wall 117 may be slidingly engaged with the case 120 such that the front wall 117 moves linearly between the open position and the closed position.

The mounting device 130 is positioned in the chamber 123, and may be at least partially defined on the rear wall 127. When the strike box 100 is assembled, the slowing mechanism 150 is movably connected to the case 120 via the mounting device 130. The mounting device 130 includes one or more features that facilitate the movable attachment of the slowing mechanism 150 to the housing 110. In the illustrated embodiment, the mounting device 130 includes a pair of posts 131 to which portions of the slowing mechanisms 150 are pivotally mounted. In other forms, the mounting device 130 may include one or more rails to which portions of the bolt-slowing assembly 150' may be slidably mounted. The mounting device 130 may further include one or more additional features that facilitate installation and/or operation of the slowing mechanisms 150. By way of example, the mounting device 130 may include one or more limiting tabs 133 operable to limit movement of the slowing mechanisms 150.

The strike plate 140 includes a first opening 142 and a second opening 144, each of which is sized and configured to receive at least one of the latchbolt 92 or the deadbolt 94. The strike plate 140 defines each of the openings 142, 144 with a fixed outer perimeter that circumferentially surrounds the opening 142/144, such that each of the openings 142, 144 has a fixed geometry. With the strike box 100 assembled and installed to the closure assembly 60, the housing openings 112, 114 are defined at least in part by the strike plate openings 142, 144. As a result, the strike plate 140 provides each of the latchbolt opening 112 and the deadbolt opening 114 with a fixed outer perimeter. The strike plate 140 may further include a flange 146 that extends in the direction of opening movement of the door 66, and which may include an angled ramp 147. When the latchbolt 92 is in its extended position and the door 66 is moved from its open position to its closed position, the ramp 147 engages the beveled surface 73 of the latchbolt 92, thereby driving the latchbolt 92 toward its retracted position against the internal biasing forces of the lockset 80.

In the illustrated form, the openings 142, 144 are of the same size, and each opening 142, 144 is operable to receive each of the latchbolt 92 the deadbolt 94 such that the orientation of the strike plate 140 relative to the case 120 can be reversed. For example, in a first orientation, the first opening 142 may define the latchbolt opening 112, and the second opening 144 may define the deadbolt opening 114. In an opposite second orientation, the first opening 142 may define the deadbolt opening 114, and the second opening 144 may define the latchbolt opening 112. As a result, the orientation of the strike plate 140 relative to the case 120 can be reversed to ensure that the flange 146 extends in the opening direction of the door 66.

Figure 3:
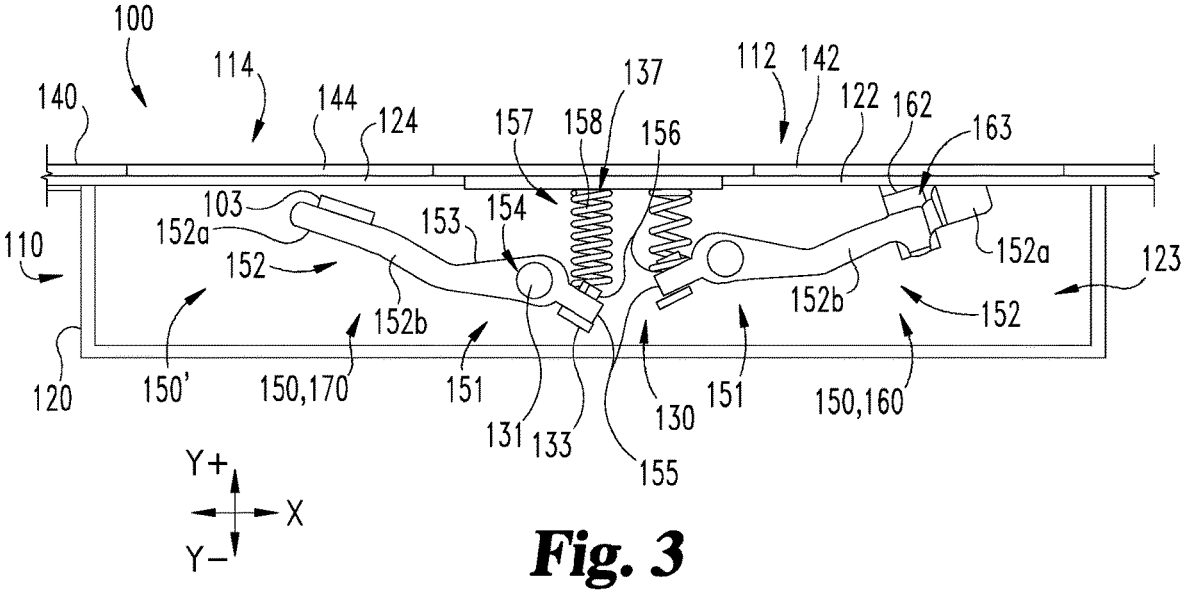
FIG. 3 is a plan view of the strike box illustrated in FIG. 1.

With additional reference to FIG. 3, each slowing mechanism 150 is mounted within the chamber 123, and includes a platform 152 and a biasing mechanism 157. The platform 152 is movably connected to the housing 110 via the mounting device 130, and is at least partially aligned with one of the openings 112, 114 such that the face 92'/94' of the corresponding bolt 92/94 engages the platform 152 as the bolt 92/94 moves toward its extended position. The platform 152 is movable in the bolt-extending ($Y^-$) direction (i.e., toward the distal wall 126) and the bolt-retracting ($Y^+$) direction (i.e., toward the corresponding opening 112/114). The biasing mechanism 157 urges the platform 152 in the bolt-retracting ($Y^-$) direction, and resists movement of the platform 152 in the bolt-extending ($Y^+$) direction. As the bolt 92/94 moves toward its extended position, the bolt 92/94 drives the platform 152 in the bolt-extending ($Y^+$) direction, and the biasing mechanism 157 resists such movement of the bolt 92/94 and the platform 152. As a result, the slowing mechanism 150 slows the extension speed of the bolt 92/94, thereby reducing the noise generated by the lockset 80 during extension of the bolt 92/94.

In the illustrated embodiment, the platform 152 is defined by a lever 151 that is pivotally mounted to the housing 110 via the mounting device 130. The lever 151 includes a body portion 153 having a pivot opening 154, and further includes first and second end portions positioned on opposite sides of the pivot opening 154. The first end portion defines the platform 152, and the second end portion defines an arm 155 that may include a protrusion 156. In the illustrated form, the biasing mechanism 157 includes a compression spring 158 that is engaged between the proximal wall 125 and the arm 155, and which may be mounted to the protrusion 156 such that the protrusion 156 aids in stabilizing the spring 158. The spring 158 urges the arm 155 in the distal or bolt-extending ($Y^-$) direction, thereby pivotally urging the platform 152 in the proximal or bolt-retracting ($Y^+$) direction. It is also contemplated that the biasing mechanism 157 may urge the platform 152 in the bolt-retracting ($Y^+$) direction in another manner. For example, the compression spring 158 may be positioned between the platform 152 and the distal wall 126, or the compression spring 158 may be replaced by a torsion spring.

Each of the mounting posts 131 extends into a corresponding one of the pivot openings 154 such that the levers 151 are pivotally supported by the mounting device 130. The mounting device 130 may further include one or more additional features that facilitate installation and/or operation of the bolt-slowing assembly 150'. By way of example, the mounting device 130 may include one or more limiting tabs 133 operable to limit the pivotal range of the lever 151, such as by engaging the arm 155. As another example, a protrusion 137 formed on the proximal wall 125 may engage the spring 158 to further aid in stabilizing and supporting the spring 158.

Figure 7:
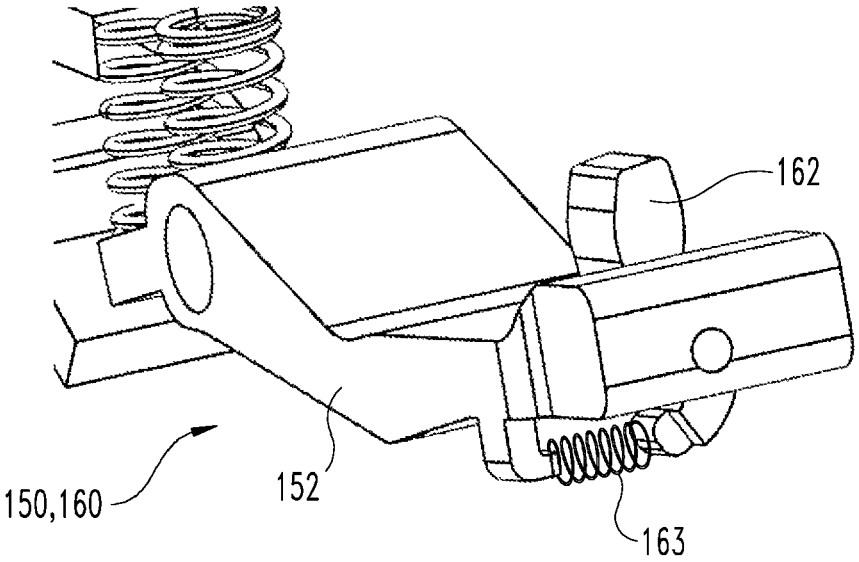
FIG. 7 is a perspective illustration of a portion of the strike box illustrated in FIG. 1, and illustrates a finger in a rearward rest position.
Figure 8:
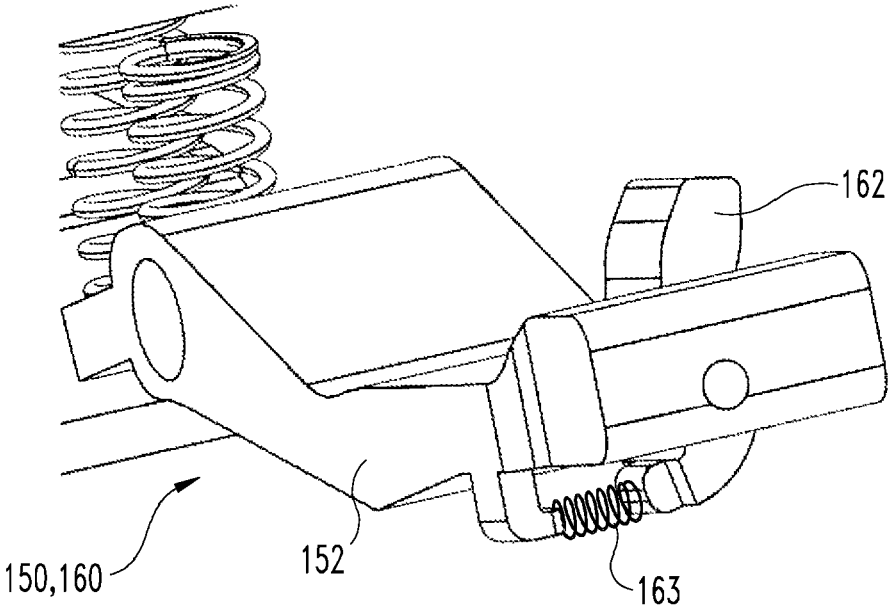
FIG. 8 is a perspective illustration of a portion of the strike box illustrated in FIG. 1, and illustrates a finger in a forward pivoted position.

The illustrated bolt-slowing assembly 150' includes a latchbolt-slowing mechanism 160 and a deadbolt-slowing mechanism 170, each of which includes a corresponding one of the slowing mechanisms 150. The latchbolt-slowing mechanism 160 may further include a finger 162 that is pivotably mounted to the platform 152, and a biasing member 163 that is engaged between the platform 152 and the finger 162. The finger 162 is movable relative to the platform 152 between a rearward rest position (FIG. 7) and a forward pivoted position (FIG. 8), and the biasing member 163 urges the finger 162 toward the rest position. The finger 162 is configured to engage the tongue 98 and to move from the rearward rest position (FIG. 7) toward the forward pivoted position (FIG. 8) in response to movement of the tongue 98 in the forward direction.

For each slowing mechanism 150, the lever 151 has a deactuated or home position and an actuated or pivoted position, and is biased toward its deactuated or home position by the corresponding biasing mechanism 157. More specifically, the spring 158 urges the arm 155 in the distal bolt-extending ($Y^-$) direction and into contact with the limiting tab 133, thereby urging the platform 152 in the proximal bolt-retracting ($Y^+$) direction. Thus, the spring 158 biases the lever 151 in a deactuating direction, and resists movement of the lever 151 in an actuating direction opposite the deactuating direction. In the orientation shown in FIGS. **4*a*-4*c*, the lever 151 of the latchbolt-slowing mechanism 160 has a clockwise (CW) actuating direction and a counter-clockwise (CCW) deactuating direction, and the lever 151 of the deadbolt-slowing mechanism 170 has a counter-clockwise (CCW) actuating direction and a clockwise (CW) deactuating direction. As movement of each lever 151 in its actuating direction is resisted by the corresponding one of the biasing mechanisms 157, the actuating direction may alternatively be referred to as a resisted direction. Conversely, with each lever 151 biased in its deactuating direction by the corresponding one of the springs 158**, the deactuating direction may alternatively be referred to as a biased direction.

Each of the latchbolt-slowing mechanism 160 and the deadbolt-slowing mechanism 170 has a deactuated state that includes the deactuated or home position of its lever 151 and an actuated state that includes the actuated or pivoted position of its lever 151. As noted above, the illustrated latchbolt-slowing mechanism 160 includes a finger 162 having a home position and a pivoted position. In addition to the home/pivoted position of the corresponding lever 151, the actuated/deactuated state of the latchbolt-slowing mechanism 160 further includes the home/pivoted position of the finger 162. More specifically, the deactuated state includes the home positions of the lever 151 and finger 162, and the actuated state includes the pivoted positions of the lever 151 and finger 162. Thus, the latchbolt-slowing mechanism 160 is biased toward its deactuated state in part by the spring 158 engaged with the lever 151, and in part by the biasing member 163 engaged with the finger 162.

FIG. **4*a* illustrates a portion of the closure assembly 60 in a first condition, which may alternatively be referred to as the "closed/unlatched" condition. In the first condition, the door 66 is in a closed position, each of the latchbolt 92 and the deadbolt 94 is in the retracted position thereof, and each of the latchbolt-slowing mechanism 160 and the deadbolt-slowing mechanism 170 is in the deactuated state thereof. The first condition may, for example, occur when the door 66 is in its partially-closed position and/or when the handle 82** is maintained in its rotated position by a user.

FIG. **4*b* illustrates a portion of the closure assembly 60 in a second condition, which may alternatively be referred to as the "latched/unlocked" condition. In the second condition, the latchbolt 92 is in its extended position and is received in the latchbolt opening 112, and the deadbolt 94 is in its retracted position. With the perimeter of the latchbolt opening 112 being fixed by the strike plate 140, engagement between the strike plate 140 and the flat side surface 72 of the latchbolt 92 prevents opening movement of the door 66 when the latchbolt 92 is in its extended position. As a result, the door 66 is latched in its fully-closed position, and the latchbolt 92 must be retracted before the door 66** can be moved toward its open position.

The closure assembly 60 may be transitioned from its first condition to its second condition by moving the latchbolt 92 from its retracted position to its extended position. Such extension of the latchbolt 92 may, for example, occur in response to the handle 82 being released from its rotated position and/or the door 66 being moved from its partially-closed position to its fully-closed position. As the closure assembly 60 transitions from its first condition (FIG. 4*a*) to its second condition (FIG. 4*b*), the latchbolt 92 enters the latchbolt opening 112 and engages the latchbolt-slowing mechanism 160. During extension of the latchbolt 92, the tongue 98 engages the finger 162 and urges the finger 162 toward its pivoted position, and the latchbolt face 92' comes into contact with the platform 152 and urges the lever 151 in its actuating direction (clockwise in FIGS. 4*a*-4*c*). Pivotal movement of the finger 162 is resisted by the biasing member 163, such that the finger 162 slows the pivotal speed of the tongue 98 during extension of the latchbolt 92. Similarly, pivotal movement of the lever 151 is resisted by the biasing mechanism 157, such that the lever 151 slows the extension speed of the latchbolt 92.

Figure 4C:
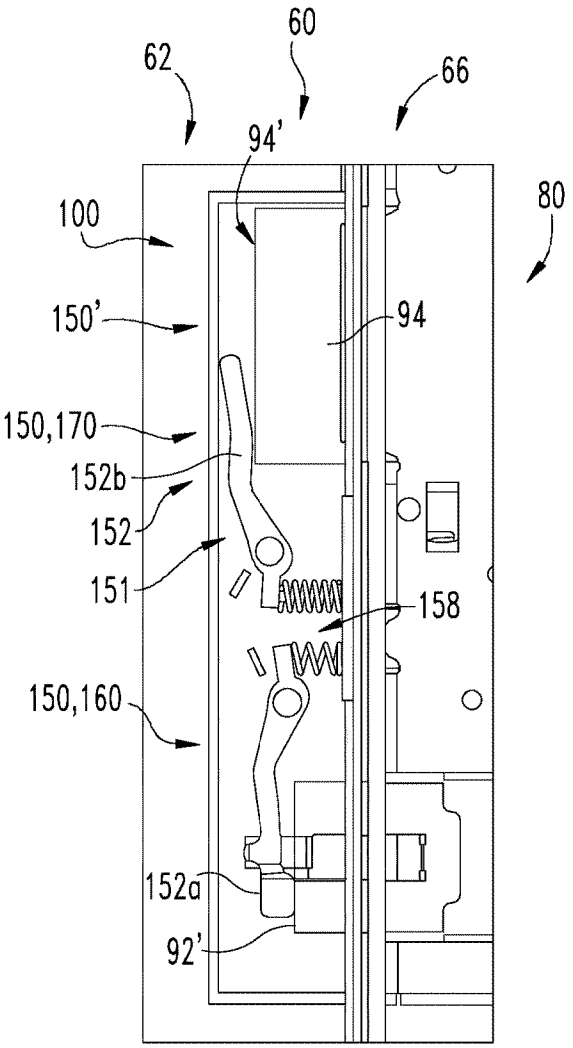
FIGS. 4*a*-4*c* illustrate a variety of operating states for the closure assembly illustrated in FIG. 1; more specifically.
Figure 4B:
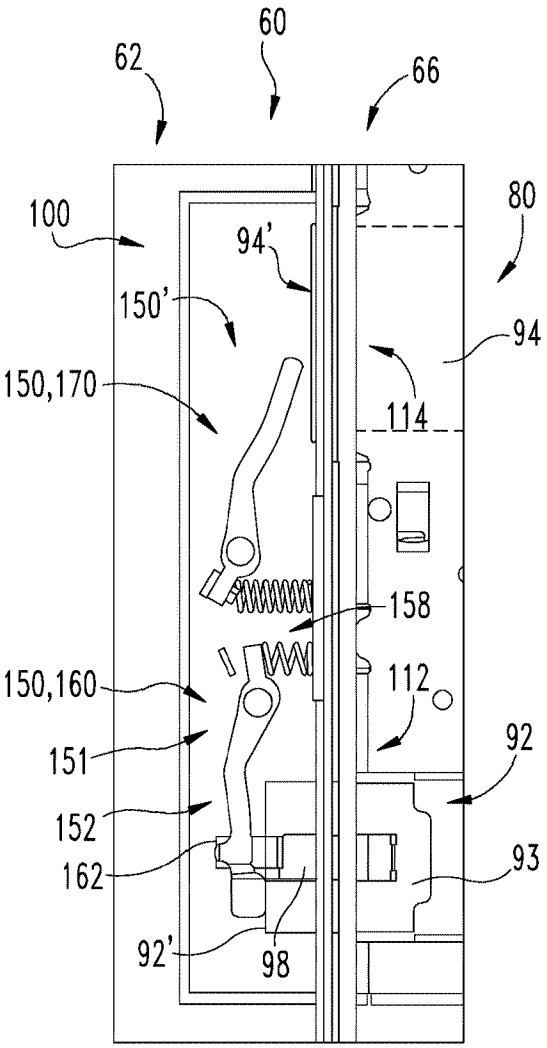
Figure 4A:
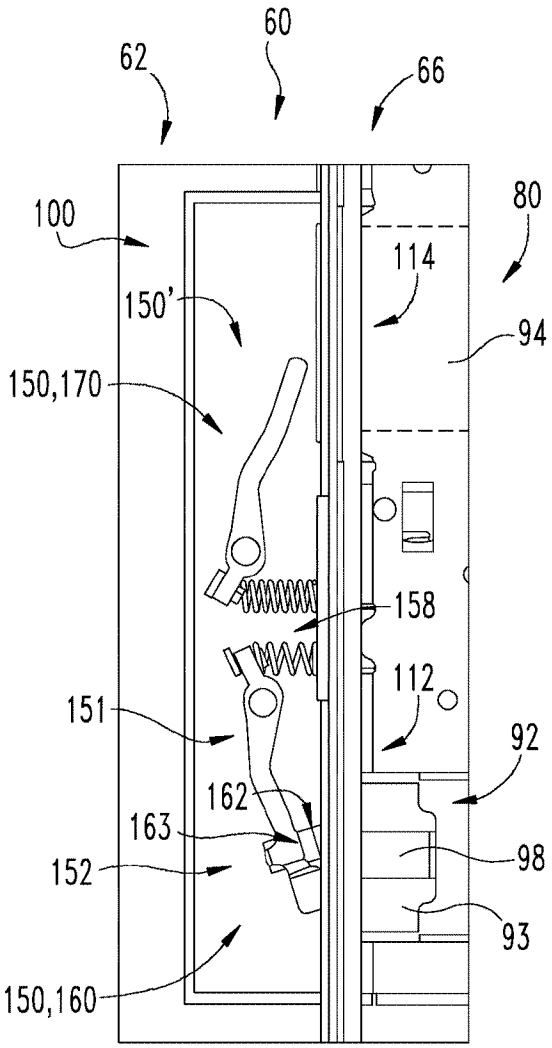

FIG. 4*c* illustrates a portion of the closure assembly 60 in a third condition, which may alternatively be referred to as the "latched/locked" condition. In the third condition, each of the latchbolt 92 and the deadbolt 94 is in the extended position thereof, and is received in the corresponding one of the openings 112, 114. With the perimeter of the deadbolt opening 114 being fixed by the strike plate 140, engagement between the strike plate 140 and the flat side surface 75 of the deadbolt 94 prevents opening movement of the door 66 when the deadbolt 94 is in its extended position. As a result, the door 66 is locked in its fully-closed position, and the deadbolt 94 must be retracted before the door 66 can be moved toward its open position.

The closure assembly 60 may be transitioned from the second condition to the third condition by moving the deadbolt 94 from its retracted position to its extended position. In certain forms, extension of the deadbolt 94 may occur as a result of a user manipulating the thumbturn 84. Alternatively, the chassis 90 may drive the deadbolt 94 toward its extended position in response to the latchbolt 92 being moved toward its extended position while the trigger 96 is depressed. As the closure assembly 60 transitions from its second condition (FIG. 4*b*) to its third condition (FIG. 4*c*), the deadbolt 94 enters the deadbolt opening 114 and engages the deadbolt-slowing mechanism 170. During extension of the deadbolt 94, the deadbolt face 94' comes into contact with the platform 152 and urges the lever 151 in its actuating direction (counter-clockwise in FIGS. 4*a*-4*c*). This pivotal movement is resisted by the biasing mechanism 157, such that the lever 151 slows the extension speed of the deadbolt 94.

In the illustrated embodiment, the latchbolt 92 and the deadbolt 94 project beyond the faceplate 88 by different distances when in the extended positions thereof, such that the bolt faces 92', 94' have different lateral positions within the chamber 123 when the closure assembly 60 is in its latched/locked state (FIG. 4*c*). More specifically, the deadbolt 94 projects into the strike box 100 by a greater distance than does the latchbolt 92. Additionally, the strike box 100 is configured such that when the bolts 92, 94 are in the extended positions thereof, the bolt faces 92', 94' engage the platforms 152 with surface-to-surface contact such that the corners of the bolts 92, 94 do not dig into the levers 151 when the closure assembly 60 is in a latched and/or locked state.

The surface-to-surface contact between the platforms 152 and the bolt faces 92', 94' may be provided at least in part by the configuration of the mounting device 130 and/or the slowing mechanisms 150. In the illustrated embodiment, the platform 152 includes first and second landings 152*a*, 152*b* that are angled relative to one another, and the posts 131 of the mounting device 130 are positioned at different lateral positions within the housing 110. The positions of the posts 131 and the geometry of the platform 152 are selected such that when the closure assembly is in the latched/locked condition (FIG. 4*c*), the end face 92' of the latchbolt 92 is in contact with the first landing 152*a* of the latchbolt-slowing mechanism 160, and the end face 94' of the deadbolt 94 is in contact with the second landing 152*b* of the deadbolt-slowing mechanism 170. As a result, stress concentrations within the levers 151 are reduced, which may lead to reduced wear and increased longevity for the slowing mechanisms 150.

As noted above, the amount of noise generated during operation of the closure assembly 60 depends upon many factors, including the speed at which various components travel during such operation. Thus, in slowing the movement speed of various components of the lockset 80 during extension of the latchbolt 92 and/or deadbolt 94, the strike box 100 may provide for a reduction in operating noise during such extension. In certain forms, the strike box 100 may include additional or alternative features that further reduce noise generation during extension of the latchbolt 92 and/or deadbolt 94. By way of example, the platform 152 may be formed of a material having a relatively low hardness, such as a plastic material or a polymeric material. In addition or as an alternative, the platform 152 may have a pad 103 mounted thereon, and the pad 103 may dampen vibrations resulting from the impact of the corresponding bolt 92/94.

In the illustrated strike box 100, the platform 152 is mounted for pivotal movement relative to the housing 110, and the biasing mechanism 157 pivotally urges the lever 151 in the deactuating direction. It is also contemplated that a strike box may include a platform that is mounted for another type of movement relative to the housing 110, and that the biasing mechanism 157 may provide a biasing force corresponding to the type of movement undergone by the platform 152. By way of example, the platform 152 may be mounted for sliding movement relative to the housing 110, and the biasing mechanism 157 may linearly urge the platform in the deactuating direction. Additionally, while the illustrated biasing mechanism 157 includes a biasing member 158 in the form of a compression spring, it is also contemplated that the biasing member 158 may be provided in another form, for example as a torsion spring, a leaf spring, or an elastic member. Furthermore, while the platform 152 and the biasing mechanism 157 are illustrated as distinct components, it is also contemplated that the functions thereof may be performed by a single component. In other words, the slowing mechanism 150 may include a component that both engages the bolt 92/94 and resists movement of the bolt 92/94 in its extending direction, such as a leaf spring or an elastic element.

In certain forms, the biasing mechanism 157 may include a damper that provides resistive forces in addition to those provided by the biasing member 158. For example, a linear damper may include a plunger having a projected position and a depressed position relative to a body portion, and the body portion may include a hydraulic chamber that resists such movement of the plunger. In such forms, the biasing member 158 may urge the plunger toward its projected position, and the resistance provided by the hydraulic chamber may further slow movement of the platform 152 and bolt 92/94 in the bolt-extending ($Y^-$) direction. It is also contemplated that a damper may be provided as a rotary damper, for example as described below with reference to FIGS. 5 and 6.

Many lockset manufacturers offer a variety of products having different configurations, and often provide one or more product lines including locksets of similar configurations. By way of illustration, the illustrated lockset 80 may be associated with a mortise lockset line in which different species of the lockset 80 have different components and/or characteristics. For example, the transmission assembly 99 included in certain species of the lockset 80 may provide for automatic extension of the deadbolt 94 in the manner described above, while the transmission assembly 99 included in other species of the lockset 80 may not necessarily provide for such automatic extension of the deadbolt 94. As the components included in the lockset 80 may vary from one species to the next, a modification that reduces the noise generated by locksets of one species may not necessarily be easily adapted to other species within the same product line. This difficulty is further compounded when it is desired to reduce noise generation across product lines of different formats. For example, a modification that reduces the noise generated by a mortise lockset may not necessarily be applicable to cylindrical locksets and/or tubular locksets. As such, it may be costly to develop and implement lockset modifications that reduce noise generation for several species of a particular lockset format, let alone across product lines of varying formats.

The foregoing difficulties may be alleviated or overcome by the strike box 100, which reduces the noise generated by the lockset 80 by slowing the extension speed of the latchbolt 92 and/or the deadbolt 94. As the noise reduction is provided by the strike box 100, the lockset 80 itself need not be modified. Thus, the same configuration of strike box 100 can be utilized in combination with several species of the lockset 80 having different configurations. Furthermore, while the strike box 100 is illustrated in association with a mortise lockset 80, it is to be appreciated that the strike box 100 may be used in combination with locksets of other formats, such as cylindrical locksets and/or tubular locksets.

Figure 5:
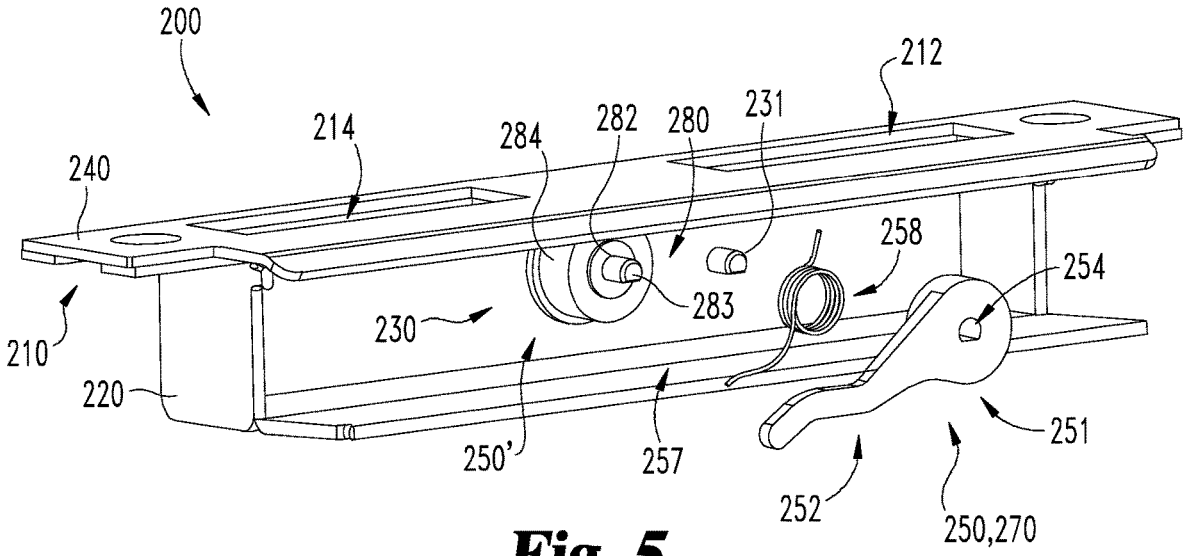
FIG. 5 is a partially-exploded assembly view of a strike box according to certain embodiments.
Figure 6:
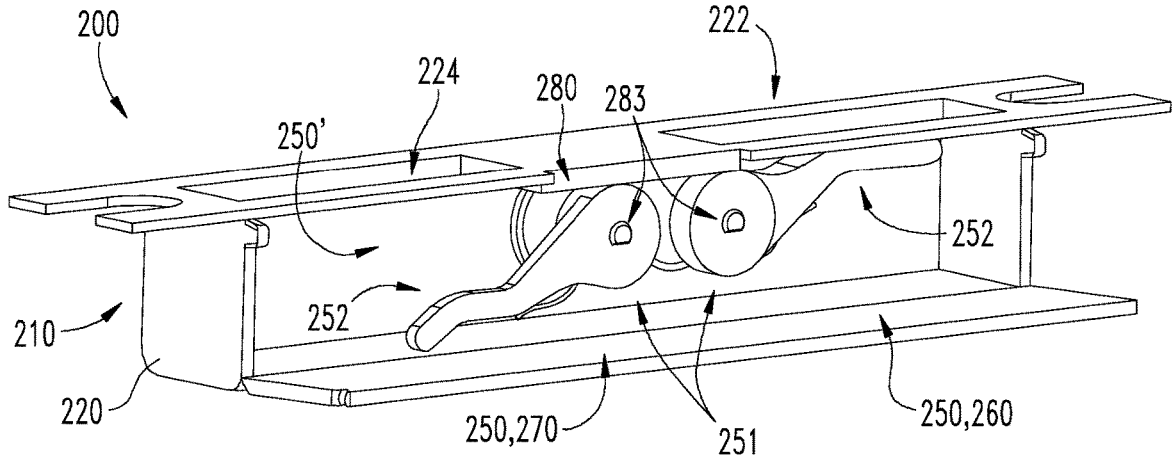
FIG. 6 is a perspective illustration of a portion of the strike box illustrated in FIG. 5.

With reference to FIGS. 5 and 6, illustrated therein is a strike box 200 according to certain embodiments. The strike box 200 is substantially similar to the strike box 100 illustrated in FIGS. 1-4, and similar reference characters are used to indicate similar elements and features. For example, the strike box 200 includes a housing 210 and a bolt-slowing assembly 250' including a pair of slowing mechanisms 250. As in the above-described strike box 100, the housing 210 includes a case 220, a mounting device 230, and a strike plate 240. The housing 210 includes a latchbolt opening 212 and a deadbolt opening 214 respectively corresponding to the latchbolt opening 112 and the deadbolt opening 114, and the case 220 includes a first opening 222 and a second opening 224 respectively corresponding to the first opening 122 and the second opening 224. Additionally, the bolt-slowing assembly 250' includes a latchbolt-slowing mechanism 260 and a deadbolt-slowing mechanism 270, each of which includes a corresponding one of the slowing mechanisms 250. In the interest of conciseness, the following description of the strike box 200 focuses primarily on elements and features that differ from those described above with reference to the strike box 100.

As with the above-described slowing mechanisms 150, each slowing mechanism 250 of the current embodiment includes a lever 251 defining a platform 252, and a biasing mechanism 257 that resists movement of the platform 252 in the actuating direction (i.e., away from the strike plate 240). In the illustrated embodiment, each biasing mechanism 257 includes a biasing member in the form of a torsion spring 258, and further includes a rotary damper 280. The damper 280 includes first and second portions 282, 284 that are rotatable relative to one another, and the damper 280 is configured to resist relative rotation of the first and second portions 282, 284. By way of example, the first and second portions 282, 284 may cooperate to define a hydraulic chamber that expands and contracts during relative rotation of the portions 282, 284, and the chamber may be filled with a hydraulic fluid that resists such expansion and retraction.

For each damper 280, the first portion 282 is configured for rotational coupling with a corresponding one of the levers 251, and the second portion 284 is configured for rotational coupling with the housing 210. By way of example, the first portion 282 may include a post 283 having a non-circular cross-section, and the opening 254 of each lever 251 may have a non-circular cross-section corresponding to that of the damper post 283. Similarly, the mounting device 230 may include a post 231 having a non-circular cross-section, and each of the second portions 284 may include an opening having non-circular cross-section corresponding to that of the mounting device post 231. As another example, the second portions 284 may include arms that engage the proximal wall and/or the distal wall to limit or prevent rotation of the second portions 284 relative to the case 220.

With the strike box 200 assembled, the biasing members 257 urge the platforms 252 in the deactuating or bolt-retracting ($Y^+$) direction (i.e., toward the strike plate 240), and resist movement of the platforms 252 in the actuating or bolt-extending ($Y^+$) direction (i.e., away from the strike plate 240). Additionally, the dampers 280 resist rotation of the levers 251 relative to the housing 210, thereby providing additional resistance to movement of the platforms 252 in the bolt-extending direction.

As will be appreciated, each of the illustrated strike boxes 100, 200 is capable of slowing the extension speed of the bolts 92, 94 without requiring modification of the lockset 80 itself. More specifically, each strike box 100, 200 includes a bolt-slowing assembly operable to slow the extension speed of a latchbolt and/or a deadbolt of a lockset, such as the latchbolt 92 and the deadbolt 94 of the illustrated mortise lockset 80. While each of the illustrated strike boxes 100, 200 includes a latchbolt bolt-slowing assembly 160/260 and a deadbolt bolt-slowing assembly 170/270, it is to be understood that other forms are contemplated. By way of illustration, a strike box may be configured to slow the movement of two or more latchbolts and/or two or more deadbolts. As another example, a strike box may be configured to slow the movement of a single bolt. Such a strike box may be configured for use with a lockset that includes a single bolt, in which case one of the openings in the strike plate may be omitted. Alternatively, such a strike box may be configured for use with a lockset including two bolts, for example where it is only desired to slow the extension speed of one of the bolts. It is also contemplated that Additionally, the strike boxes 100, 200 are capable of slowing the bolts 92, 94 without the use of electronic components, which typically require connection to line power and/or an on-board power source. The strike boxes 100, 200 may therefore be provided in a purely mechanical form that is wholly devoid of electronic components. It is also contemplated, however, that a biasing mechanism may include one or more electronic components. For example, a biasing mechanism may include a rotary motor that, when back-driven, produces a resistive force analogous to that provided by the damper 280.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A strike box configured for use with an access control device including a first movable bolt and a second movable bolt, the strike box comprising:

a case including a chamber having a length extending along a longitudinal axis, a depth extending along a lateral axis, and a width extending along a transverse axis;

a faceplate including a first bolt opening operable to receive the first bolt in a lateral direction and a second bolt opening operable to receive the second bolt in the lateral direction;

a first slowing mechanism movably mounted in the chamber, wherein the first slowing mechanism includes a first lever having a length extending along the longitudinal axis and having a first bolt-engaging platform aligned with the first bolt opening, and wherein the first bolt-engaging platform is configured to engage the first bolt to resist movement of the first bolt-in the lateral direction such that the first slowing mechanism is operable to slow an extension speed of the first bolt in the lateral direction; and a second slowing mechanism movably mounted in the chamber, wherein the second slowing mechanism includes a second lever having a length extending along the longitudinal axis and having a second bolt-engaging platform aligned with the second bolt opening, and wherein the second bolt-engaging platform is configured to engage the second bolt to resist movement of the second bolt in the lateral direction such that the second slowing mechanism is operable to slow an extension speed of the second bolt in the lateral direction; and wherein the first lever is pivotally mounted to the case for pivotal movement about a first axis arranged transverse to the longitudinal axis, and wherein the second lever is pivotally mounted to the case for pivotal movement about a second axis arranged transverse to the longitudinal axis.

2. The strike box of claim 1, wherein the first slowing mechanism comprises a spring.

3. The strike box of claim 2, wherein the first slowing mechanism further comprises a damper.

4. The strike box of claim 1, wherein the first axis is offset from the second axis.

5. A strike box configured for use with an access control device including a first movable bolt and a second movable bolt, the strike box comprising:

a case including a chamber, wherein the case comprises a plurality of walls, and wherein a first wall of the plurality of walls is movable between an open position and a closed position to selectively expose the chamber;

a faceplate including a first bolt opening operable to receive the first bolt and a second bolt opening operable to receive the second bolt;

a first slowing mechanism movably mounted in the chamber, wherein the first slowing mechanism includes a first bolt-engaging portion that is aligned with the first bolt opening, and wherein at least a portion of the first slowing mechanism is configured to resist movement of the first bolt-engaging portion in a distal direction such that the first slowing mechanism is operable to slow an extension speed of the first bolt in the distal direction; and a second slowing mechanism movably mounted in the chamber, wherein the second slowing mechanism includes a second bolt-engaging portion that is aligned with the second bolt opening, and wherein at least a portion of the second slowing mechanism is configured to resist movement of the second bolt-engaging portion in the distal direction such that the second slowing mechanism is operable to slow an extension speed of the second bolt in the distal direction.

6. The strike box of claim 5, further comprising a retainer operable to selectively retain the first wall in the closed position.

7. The strike box of claim 5, wherein the first wall is connected to a second wall of the plurality of walls via a hinge connection.

8. The strike box of claim 7, wherein the case is formed of a plastic material; and wherein the hinge connection comprises a living hinge.

9. A method of reducing noise generated by an access control device, the method comprising:

during extension of a first bolt of the access control device, engaging the first bolt with a first slowing mechanism of a strike box having an overall length extending along a longitudinal axis, an overall depth extending along a lateral axis, and an overall width extending along a transverse axis, and wherein the overall length of the strike box is greater than the overall depth and the overall width of the strike box;

with the first bolt engaged with the first slowing mechanism, pivoting the first slowing mechanism about a first axis arranged transverse to the longitudinal axis to resist extension of the first bolt, thereby reducing an extension speed of the first bolt;

during extension of a second bolt of the access control device, engaging the second bolt with a second slowing mechanism of the strike box; and with the second bolt engaged with the second slowing mechanism, pivoting the second slowing mechanism about a second axis arranged transverse to the longitudinal axis to resist extension of the second bolt, thereby reducing an extension speed of the second bolt.

10. The method of claim 9, wherein the first slowing mechanism comprises a first engagement portion that engages the first bolt; and wherein causing the first slowing mechanism to resist extension of the first bolt comprises resisting movement of the first engagement portion in a distal direction.

11. The method of claim 10, wherein resisting movement of the first engagement portion in the distal direction comprises biasing, by a spring, the first engagement portion in a proximal direction opposite the distal direction.

12. The method of claim 10, wherein resisting movement of the first engagement portion in the distal direction comprises resisting, by a damper, the movement of the first engagement portion in the distal direction.

13. The method of claim 12, wherein the first engagement portion is pivotable relative to a housing of the strike box; and wherein the damper is a rotary fluid damper.

14. The method of claim 10, wherein the second slowing mechanism comprises a second engagement portion that engages the second bolt; and wherein causing the second slowing mechanism to resist extension of the second bolt comprises resisting movement of the second engagement portion in the distal direction.

15. The method of claim 9, further comprising damping, by a pad mounted to the first slowing mechanism, an impact of the first bolt on the first slowing mechanism.

16. The method of claim 9, wherein the first axis is offset from the second axis.

17. A method of reducing noise generated by an access control device comprising a latchbolt, the latchbolt having a retracted position and an extended position offset from the retracted position in a distal direction, the latchbolt including a latchbolt head and a tongue having a first tongue position and a second tongue position offset from the first tongue position in a forward direction transverse to the distal direction, the method comprising:

during extension of the latchbolt in the distal direction, engaging the latchbolt with a platform of a strike box, and engaging the tongue with a finger movably supported by the platform;

resisting movement of the platform in the distal direction, thereby slowing an extension speed of the latchbolt; and resisting movement of the finger in the forward direction, thereby slowing a movement speed of the tongue.

18. The method of claim 17, wherein resisting movement of the platform in the distal direction comprises resisting, by a first spring, movement of the platform in the distal direction.

19. The method of claim 18, wherein resisting movement of the finger in the forward direction comprises resisting, by a second spring, movement of the finger in the forward direction.

20. The method of claim 17, further comprising:

during extension of a deadbolt of the access control device in the distal direction, engaging a deadbolt with a second platform of the strike box; and resisting movement of the second platform in the distal direction, thereby slowing an extension speed of the deadbolt.

21. A method of reducing noise generated by an access control device, the method comprising:

during extension of a first bolt of the access control device, engaging the first bolt with a first slowing mechanism of a strike box having a length extending along a longitudinal axis;

with the first bolt engaged with the first slowing mechanism, pivoting the first slowing mechanism about a first axis arranged transverse to the longitudinal axis to resist extension of the first bolt, thereby reducing an extension speed of the first bolt;

during extension of a second bolt of the access control device, engaging the second bolt with a second slowing mechanism of the strike box; and with the second bolt engaged with the second slowing mechanism, pivoting the second slowing mechanism about a second axis arranged transverse to the longitudinal axis to resist extension of the second bolt, thereby reducing an extension speed of the second bolt, and wherein the first axis is offset from the second axis.

* * * * *